US006739271B1

(12) United States Patent
Hancock

(10) Patent No.: US 6,739,271 B1
(45) Date of Patent: May 25, 2004

(54) ADVERTISING TABLE

(76) Inventor: James Cass Hancock, 94 Currituck Rd., Newtown, CT (US) 06470

( * ) Notice: Subject to any disclaimer, the term of this patent is extended or adjusted under 35 U.S.C. 154(b) by 0 days.

(21) Appl. No.: 10/109,299

(22) Filed: Mar. 27, 2002

Related U.S. Application Data

(60) Provisional application No. 60/280,052, filed on Mar. 30, 2001.

(51) Int. Cl.[7] ..... A47B 13/08
(52) U.S. Cl. ..... 108/90; 108/27
(58) Field of Search ..... 108/90, 13, 10, 108/14, 38, 161, 27

(56) References Cited

U.S. PATENT DOCUMENTS 1,906,213 A * 4/1933 Neuschotz et al.
2,529,051 A * 11/1950 Sherman
3,802,708 A * 4/1974 Libert
4,450,774 A * 5/1984 Weaver
4,821,651 A * 4/1989 Peng
4,841,878 A * 6/1989 Kriegsman
4,905,611 A * 3/1990 Jung-Chung
5,600,911 A * 2/1997 Lucci
5,697,305 A * 12/1997 Chasan et al.
5,911,496 A * 6/1999 Hojnacki
6,123,031 A * 9/2000 Hayman-Chaffey

FOREIGN PATENT DOCUMENTS

GB 2029198 A * 3/1980

* cited by examiner

*Primary Examiner*—Jose V. Chen
(74) *Attorney, Agent, or Firm*—Steven McHugh, Esq.

(57) ABSTRACT

A tabletop advertising system includes a tabletop defining an internal cavity for holding an advertising element, the tabletop being configurable between a first position wherein the tabletop is arranged for use as a table with the advertising element in a visible location, and a second position for accessing the advertising element.

8 Claims, 3 Drawing Sheets

ADVERTISING TABLE

This application claims the benefit of Provisional Application Ser. No. 60/280,052, filed Mar. 30, 2001.

BACKGROUND OF THE INVENTION

The present invention relates to a table having a tabletop advertising system that employs a replaceable advertising element, wherein the tabletop is configurable so as to allow the advertising element to be easily accessed, maintained and/or replaced.

Tabletop advertising systems are well known in the prior art and are used to advertise many types of products and services. Conventional tabletop advertising systems employ a supporting member and a tabletop having a transparent or semi-transparent top surface, wherein the top surface is placed over and mounted to the supporting member and wherein an advertising element is placed between the tabletop and the transparent top surface so that the advertising element is visible to anyone in view of the tabletop. Although these tabletop advertising systems allow the advertising element to be replaced and/or modified, these systems are flawed in that tools and a large amount of effort are needed to perform this task. For example, one design requires that the top surface be removed from the tabletop in order to access the advertising element. Consequently, to do this the tabletop must be removed from the supporting member requiring a great deal of effort and the use of tools. Another design requires that the side of the tabletop be removed so as to access the advertising element via the side of the tabletop. This also requires tools and a great deal of effort. Therefore, a need remains for a tabletop advertising system which employs a tabletop having a transparent top surface and a replaceable advertising element, wherein the advertising element can be accessed, removed and/or replaced without tools and without a great deal of effort.

It is therefore the primary objective of the present invention to provide a tabletop advertising system which employs a tabletop having a transparent top surface and a replaceable advertising element, wherein the advertising element can be accessed, removed and/or replaced without a great deal of effort.

SUMMARY OF THE INVENTION

In accordance with the present invention, the foregoing objects and advantages are readily attained.

A tabletop advertising system is provided having a tabletop defining an internal cavity for holding an advertising element, said tabletop being configurable between a first position wherein said tabletop is arranged for use as a table with said advertising element in a visible location, and a second position for accessing said advertising element.

Other objects and advantages will appear hereinbelow.

BRIEF DESCRIPTION OF THE DRAWINGS

A detailed description of preferred embodiments of the present invention follows, with reference to the attached drawings, wherein like numerals depict like elements.

DETAILED DESCRIPTION

In accordance with the present invention, a table is provided which includes a tabletop having a tabletop advertising system that employs a replaceable advertising element, wherein the tabletop is configurable between a first position and a second position so as to allow the advertising element to be easily accessed, maintained and/or replaced.

Figure 1:
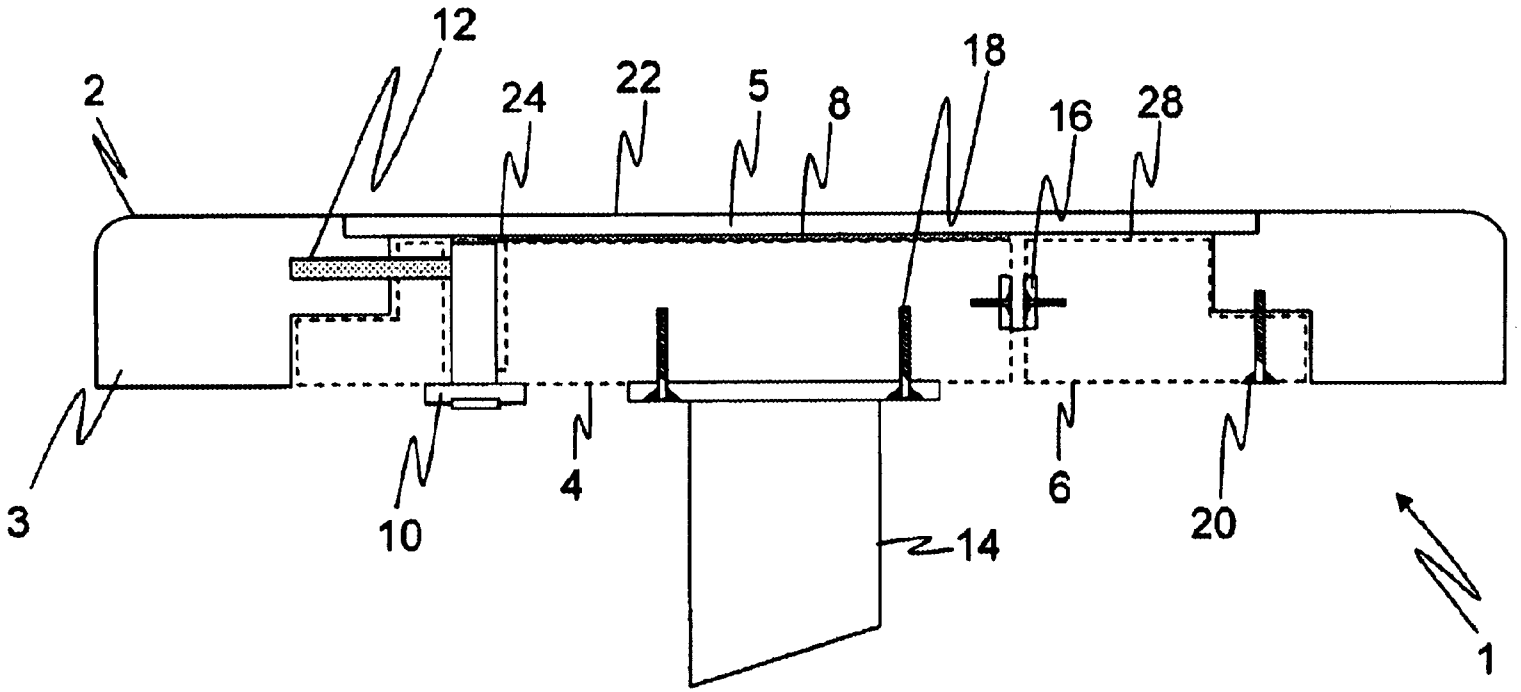
FIG. 1 illustrates a side sectional view of a tabletop advertising system configured into a first position for use as a table, in accordance with the present invention.
Figure 2:
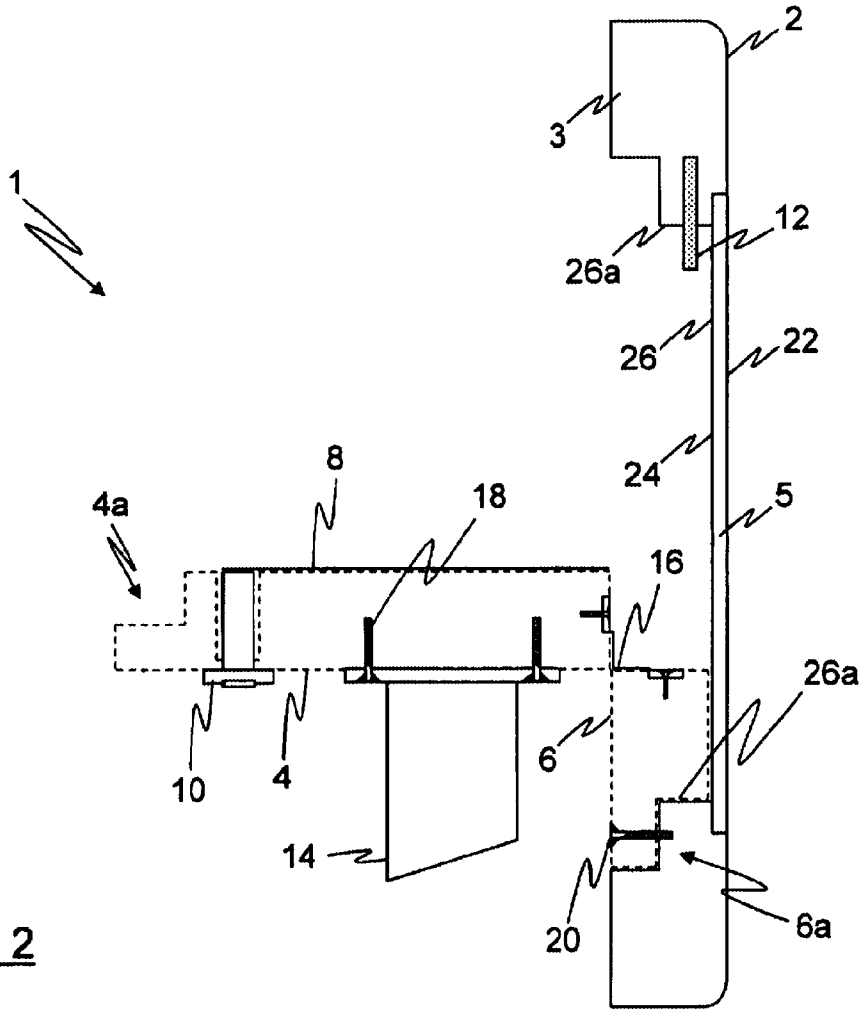
FIG. 2 illustrates a side sectional view of a tabletop advertising system configured into a second position for accessing, maintaining and/or replacing an advertising element, in accordance with the present invention.

Referring to the drawings, a preferred embodiment will now be discussed. Referring to FIG. 1 and FIG. 2, a side sectional view of a tabletop advertising system 1 is shown in a first position (FIG. 1) for use as a table and in a second position (FIG. 2) for accessing the advertising element of the tabletop advertising system 1. In the embodiment of FIGS. 1 and 2, the tabletop advertising system 1 includes a tabletop 2, an anchor plate 4, a hinging plate 6, an advertising element 8, a first locking member 10, a second locking member 12, a pedestal 14, at least one hinging member 16, at least one anchoring member 18 and at least one mounting member 20.

Figure 3:
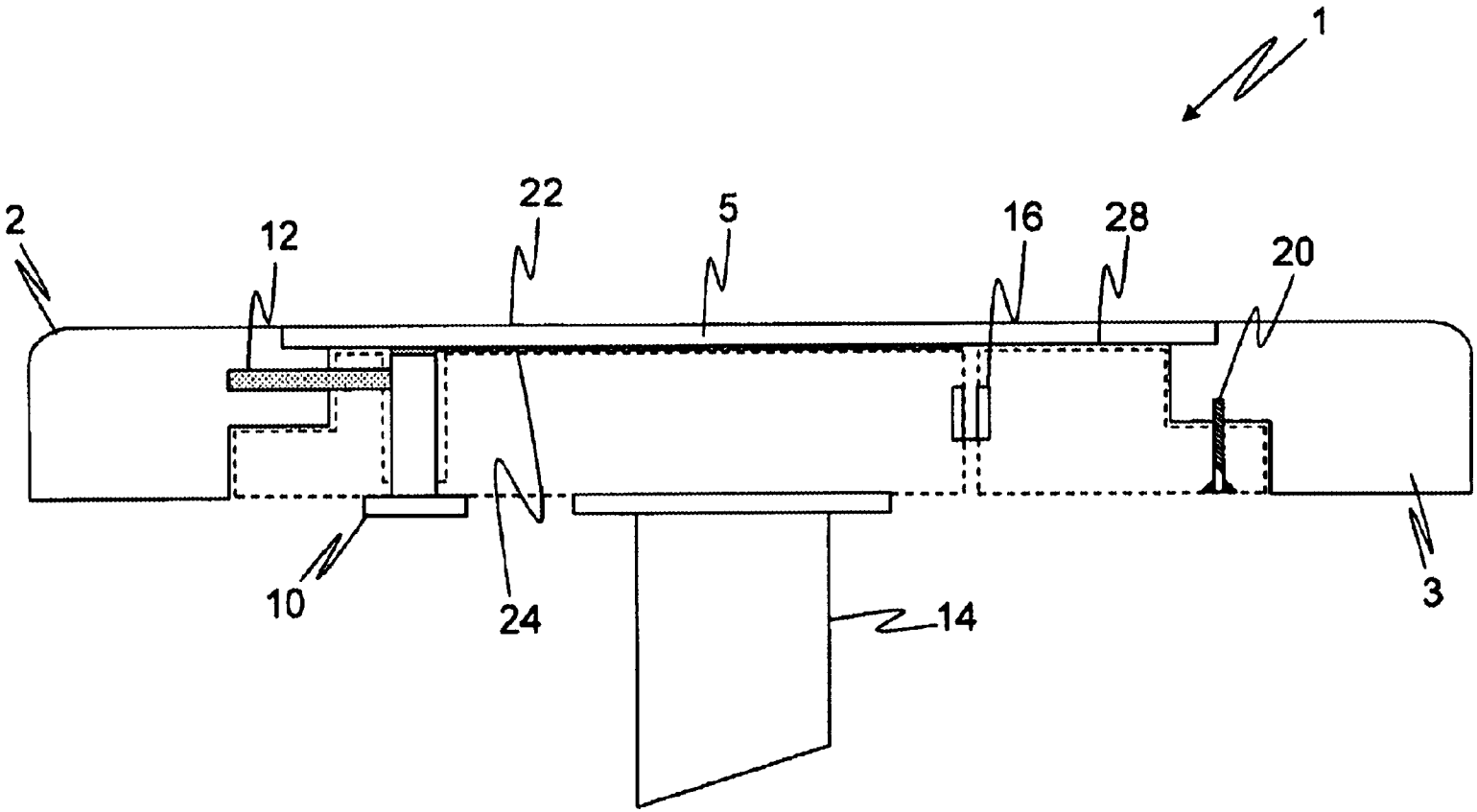
FIG. 3 illustrates a side sectional view of a tabletop in accordance with the present invention.

In accordance with the present invention and referring to FIG. 1, FIG. 2 and FIG. 3, tabletop 2 includes a top surface 22 and a bottom surface 24, wherein the bottom surface 24 includes a recessed area 26 for receiving the combination of anchor plate 4 and hinging plate 6 when the tabletop advertising system 1 is in the first position (FIG. 1). In accordance with the present invention, recessed area 26 is sized and shaped so as to allow the combination of anchor plate 4 and hinging plate 6 to be non-movably disposed within recessed area 26 when the tabletop advertising system 1 is in the first position. This further supports tabletop 2 relative to anchor plate 4 and hinging plate 6, so as to avoid excessive stress on hinging members 16, due to twisting of tabletop 2 relative to anchor plate 4 and hinging plate 6. Recessed area 26, as shown in the drawings, has side walls 26*a* which are configured to substantially abut side surfaces of anchor plate 4, and preferably hinging plate 6 as well, so as to provide surface to surface interaction between anchor plate 4 and tabletop 2, thereby reducing or preventing twisting of tabletop 2 relative to anchor plate 4, which could damage hinging member 16.

Still referring to the drawings, and as best shown in FIG. 2, an outer edge of anchor plate 4 and hinging plate 6 may be provided with a stepped structure 4*a*, 6*a*, which provides further surfaces that are useful for providing desired interaction between anchor plate 4 and hinging plate 6 on the one hand, and tabletop 2 on the other hand. Further, and as described below, this also provides substantially horizontal surfaces that overlap between tabletop 2 and anchor plate 4/hinging plate 6, which provides for secure attachment of hinging plate 6 to tabletop 2 as will be discussed below, and which further supports tabletop 2 relative to anchor plate 4 while relieving stresses on anchoring members 16 as desired. In addition, the combination of anchor plate 4 and hinging plate 6 is preferably disposed within recessed area 26 so as to define a cavity or gap 28 between the bottom surface 24 and the combination of anchor plate 4 and hinging plate 6, thus allowing advertising element 8 to be disposed within cavity 28.

Tabletop 2 may advantageously be provided as a rim or frame member 3 supporting a transparent member 5, preferably such that transparent member 5 is securely held in place in the position of FIG. 1, and further preferably such that member 5 can be easily removed and replaced if necessary, when in the position of FIG. 2, for example due to wear and tear or other damage to transparent member 5. Alternatively, any suitable adhesive could be used to secure transparent member 5 within frame 3 as desired. In this embodiment, of course, only transparent member 5 need be manufactured of transparent material. Alternatively, table top 2 may be provided as a single unitary construction if desired, for example by molding from sufficiently transparent plastic.

In accordance with the present invention, the pedestal 14 is preferably non-movably attached to anchor plate 4 via at least one anchoring member 18. Hinging plate 6 is preferably movably attached to anchor plate 4 via at least one hinging member 16 so as to allow hinging plate 6 to hingedly rotate relative to anchor plate 4. Tabletop 2 is preferably constructed of a durable transparent material and is preferably non-movably mounted to hinging plate 6 via at least one mounting member 20. In addition, anchor plate 4 includes first locking member 10 and tabletop 2 includes second locking member 12, each disposed so as to interact with each other when the tabletop advertising system 1 is in the first position.

In accordance with the present invention, when the tabletop advertising system 1 is in the first position, advertising element 8 is preferably disposed within cavity 28 so as to be visible through tabletop 2. In addition, one of the first locking member 10 and the second locking member 12 engages the other of the first locking member 10 and the second locking member 12 so as to cause tabletop 2 to be non-movably disposed on anchor plate 4. When the advertising element 8 needs to be accessed, maintained and/or replaced, one of the first locking member 10 and the second locking member 12 is then deactivated. This causes one of the first locking member 10 and the second locking member 12 to disengage the other of the first locking member 10 and the second locking member 12 thus allowing the hinging plate 6 to rotate away from, and relative to, anchor plate 4 causing anchor plate 4 to be removed from cavity 28 thus allowing access to advertising element 8 disposed within cavity 28. Advertising element 8 is then accessed, maintained and/or replaced and hinging plate 6 is rotated back toward anchor plate 4. One of the first locking member 10 and the second locking member 12 is then activated so as to cause one of the first locking member 10 and the second locking member 12 to engage the other of the first locking member 10 and the second locking member 12 thus causing tabletop 2 to be non-movably disposed on anchor plate 4.

At least one of the first locking member 10 and the second locking member 12 may be controlled via a key, a latch or the like.

In this regard, a key lock mechanism is advantageous in that a person needing to access advertisement material 8 within system 1 need only have the key as opposed to the tools needed with conventional displays. Of course, any suitable lock and key structure would be suitable and well known to the person of ordinary skill in the art.

One particularly preferred type of locking mechanism for use in accordance with the invention is an interchangeable core lock, wherein the core of the lock can be readily replaced with a master key so as to allow rapid change of the lock. This would advantageously allow for secure changeover to a new advertising customer by the owner of the system without fear that an earlier user would still have access to the system.

It is considered within the scope of the present invention that tabletop 2 may be constructed of any suitable materials or composition of materials known in the art and suitable to the desired end purpose.

It is considered within the scope of the present invention that hinging member 16 may be any suitable hinging member known in the art.

It is considered within the scope of the present invention that anchoring member 18 may be any suitable anchoring member known in the art such as threaded fasteners, bolts, adhesives and the like.

It is considered within the scope of the present invention that mounting member 20 may be any suitable mounting member known in the art such as threaded fasteners, bolts adhesives and the like.

It is considered within the scope of the present invention that anchor plate 4 may be constructed of any suitable materials or composition of materials known in the art and suitable to the desired end purpose.

It is considered within the scope of the present invention that hinging plate 6 may be constructed of any suitable materials or composition of materials known in the art and suitable to the desired end purpose.

It is also to be understood that this invention is not limited to the illustrations described and shown herein, which are deemed to be merely illustrative of the best mode(s) of carrying out the invention, and which are susceptible to modification of form, size, arrangement of parts and details of operation. The invention rather is intended to encompass all such modifications which are within its spirit and scope.

What is claimed is:

1. A tabletop advertising system, comprising:

a support member;

an anchor plate fixed to said support member;

a hinging plate hingingly connected to said anchor plate via at least one hinging member; and a tabletop connected to said hinging plate, said tabletop defining an internal cavity for holding an advertising element and being pivotably configurable around said at least one hinging member between a first position wherein said tabletop is arranged for use as a table with said advertising element in a visible location, and a second position for accessing said advertising element.

2. The system of claim 1, wherein said tabletop has a top surface and a bottom surface, and wherein said bottom surface defines a recessed area for receiving said anchor plate and said hinging plate in said first position.

3. The system of claim 2, wherein said recessed area defines side walls adapted to abut side surfaces of said anchor plate so as to prevent twisting of said tabletop relative to said anchor plate.

4. The system of claim 1, wherein said tabletop further comprises a transparent portion positioned relative to said internal cavity whereby, in said first position, said advertising element is visible, exterior of said table through said transparent portion.

5. The system of claim 1, further comprising a locking structure positioned on said tabletop for locking said tabletop in said first position.

6. The system of claim 5, wherein said locking structure comprises an interchangeable core locking structure.

7. The system of claim 1, further comprising a locking structure positioned between said tabletop and said anchor plate for locking said tabletop relative to said anchor plate in said first position.

8. The system of claim 7, wherein said locking structure further comprises an interchangeable core locking structure.

* * * * *